US011052681B2

(12) United States Patent
Yamaguchi et al.

(10) Patent No.: US 11,052,681 B2
(45) Date of Patent: Jul. 6, 2021

(54) INKJET PRINTING APPARATUS, CONTROL METHOD OF INKJET PRINTING APPARATUS, AND STORAGE MEDIUM

(71) Applicant: CANON KABUSHIKI KAISHA, Tokyo (JP)

(72) Inventors: Toshiaki Yamaguchi, Machida (JP); Daigo Kuronuma, Kawasaki (JP); Ryutaro Takahashi, Tokyo (JP); Naoaki Wada, Yokohama (JP); Tomohito Abe, Yokohama (JP); Noriyuki Aoki, Tokyo (JP); Ryohei Maruyama, Kawasaki (JP); Masakazu Nagashima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/831,892

(22) Filed: Mar. 27, 2020

(65) Prior Publication Data

US 2020/0307270 A1 Oct. 1, 2020

(30) Foreign Application Priority Data

Mar. 29, 2019 (JP) ..... JP2019-066220

(51) Int. Cl.

| | |
|---|---|
| ***B41J 11/68*** | (2006.01) |
| ***B41J 11/66*** | (2006.01) |
| ***B41J 2/01*** | (2006.01) |
| ***B41J 11/42*** | (2006.01) |
| ***B41J 13/00*** | (2006.01) |

(52) U.S. Cl.

CPC ..... *B41J 11/663* (2013.01); *B41J 2/01* (2013.01); *B41J 11/42* (2013.01); *B41J 11/68* (2013.01); *B41J 13/0009* (2013.01)

(58) Field of Classification Search

CPC ... B41J 11/663; B41J 2/01; B41J 11/42; B41J 13/0009; B41J 11/70; B41J 11/68; B41J 11/706; B41J 11/703

See application file for complete search history.

(56) References Cited

U.S. PATENT DOCUMENTS 4,361,844 A 11/1982 Nozaki et al.
4,411,540 A 10/1983 Nozaki et al.
(Continued)

FOREIGN PATENT DOCUMENTS

JP 2006-334938 A 12/2006

OTHER PUBLICATIONS

Machine translation of JP 2006-334938, published on Dec. 2006.*

*Primary Examiner* — Huan H Tran
(74) *Attorney, Agent, or Firm* — Venable LLP

(57) ABSTRACT

An inkjet printing apparatus includes: a conveyance unit configured to convey a printing medium in a conveyance direction; a print head configured to print an image on the printing medium conveyed by the conveyance unit; and a slitter disposed on a downstream relative to the print head in the conveyance direction and configured to cut the printing medium in the conveyance direction in accordance with the conveyance by the conveyance unit, wherein the slitter is configured to cut the printing medium from a leading edge of the printing medium up to a predetermined position in accordance with the conveyance of the printing medium by the conveyance unit, and wherein the print head is configured to print the image in between the leading edge of the printing medium and the predetermined position in the conveyance direction after the printing medium is cut by the slitter.

14 Claims, 16 Drawing Sheets

(56) References Cited

U.S. PATENT DOCUMENTS

| | | | | |
|---|---|---|---|---|
| 4,684,962 | A | 8/1987 | Hirosawa et al. | |
| 5,311,214 | A | 5/1994 | Hirasawa et al. | |
| 5,339,098 | A | 8/1994 | Nagatomo et al. | |
| 5,359,358 | A | 10/1994 | Shimamura et al. | |
| 5,548,308 | A | 8/1996 | Nagatomo et al. | |
| 5,576,744 | A | 11/1996 | Niikura et al. | |
| 5,721,581 | A | 2/1998 | Saito et al. | |
| 5,757,403 | A | 5/1998 | Nagashima | |
| 5,859,653 | A | 1/1999 | Aoki et al. | |
| 6,024,434 | A | 2/2000 | Shimamura et al. | |
| 6,142,599 | A | 11/2000 | Ishinaga et al. | |
| 6,151,051 | A | 11/2000 | Ikeda et al. | |
| 6,196,655 | B1 | 3/2001 | Hirasawa et al. | |
| 6,435,675 | B2 | 8/2002 | Okura et al. | |
| 6,966,629 | B2 | 11/2005 | Nakajima et al. | |
| 7,144,093 | B2 | 12/2006 | Nakajima et al. | |
| 8,197,043 | B2 | 6/2012 | Watanabe et al. | |
| 8,419,155 | B2 | 4/2013 | Kawakami et al. | |
| 9,004,638 | B2 | 4/2015 | Wakayama et al. | |
| 2012/0050405 | A1 | 3/2012 | Abe | |
| 2013/0208043 | A1 | 8/2013 | Kawakami et al. | |
| 2015/0217580 | A1* | 8/2015 | Yamamoto | B41J 11/68<br>347/220 |
| 2016/0339721 | A1 | 11/2016 | Arai et al. | |
| 2019/0232641 | A1 | 8/2019 | Kuronuma et al. | |
| 2020/0307271 | A1* | 10/2020 | Koda | B41J 11/42 |
| 2020/0307272 | A1* | 10/2020 | Suzuki | B26D 1/245 |
| 2020/0307273 | A1* | 10/2020 | Kuronuma | B41J 11/007 |
| 2021/0053373 | A1* | 2/2021 | Mindler | B26D 5/00 |

* cited by examiner

INKJET PRINTING APPARATUS, CONTROL METHOD OF INKJET PRINTING APPARATUS, AND STORAGE MEDIUM

BACKGROUND OF THE INVENTION

Field of the Invention

The present invention relates to an inkjet printing apparatus, a control method of the inkjet printing apparatus, and a storage medium.

Description of the Related Art

There is a printing apparatus that prints an image on a roll sheet. Japanese Patent Laid-Open No. 2006-334938 (hereinafter referred to as Document 1) discloses a thermal head printer that is provided with a pair of cutting cutters on the left and right side of the width direction of a roll sheet for cutting the width of a roll sheet to into a given size. The cutting cutters are movable to given positions in the width direction of a roll sheet and is configured to cut a roll sheet in parallel to the conveyance direction of the roll sheet. In Document 1, it is disclosed that a roll sheet, on which an image is printed, is cut by the cutting cutters.

In a case where the technology of Document 1 is applied to a printing apparatus of an ink jet system, a roll sheet may not be properly cut. In a printing apparatus of an ink jet system, unlike a thermal system, a sheet on which an image is printed absorbs ink and may float from the conveyance surface or bend so as to wave. For this reason, there is a possibility that, in a case where a roll sheet on which an image is printed by ejection of ink is cut in parallel to the conveyance direction, the roll sheet is undesirably cut at a position shifted from a position where the roll sheet is supposed to be cut.

SUMMARY OF THE INVENTION

An inkjet printing apparatus according to an embodiment of the present invention includes: a conveyance unit configured to convey a printing medium in a conveyance direction; a print head configured to print an image on the printing medium conveyed by the conveyance unit; and a slitter disposed on a downstream relative to the print head in the conveyance direction and configured to cut the printing medium in the conveyance direction in accordance with the conveyance by the conveyance unit, wherein the slitter is configured to cut the printing medium from a leading edge of the printing medium up to a predetermined position in accordance with the conveyance of the printing medium by the conveyance unit, and wherein the print head is configured to print the image in between the leading edge of the printing medium and the predetermined position in the conveyance direction after the printing medium is cut by the slitter.

Further features of the present invention will become apparent from the following description of exemplary embodiments with reference to the attached drawings.

DESCRIPTION OF THE EMBODIMENTS

Hereinafter, an explanation is given of embodiments of the present invention with reference to the drawings. The following embodiments do not limit the present invention. Further, every combination of the characteristics explained in the present embodiments is not essential to the solution means of the present invention. The same reference sign is assigned for explanation of the identical configuration. In addition, relative positions, shapes, and the like, of the constituent elements described in the embodiments are merely examples and are not intended to limit the present invention to the range of the examples.

First Embodiment

Figure 1:
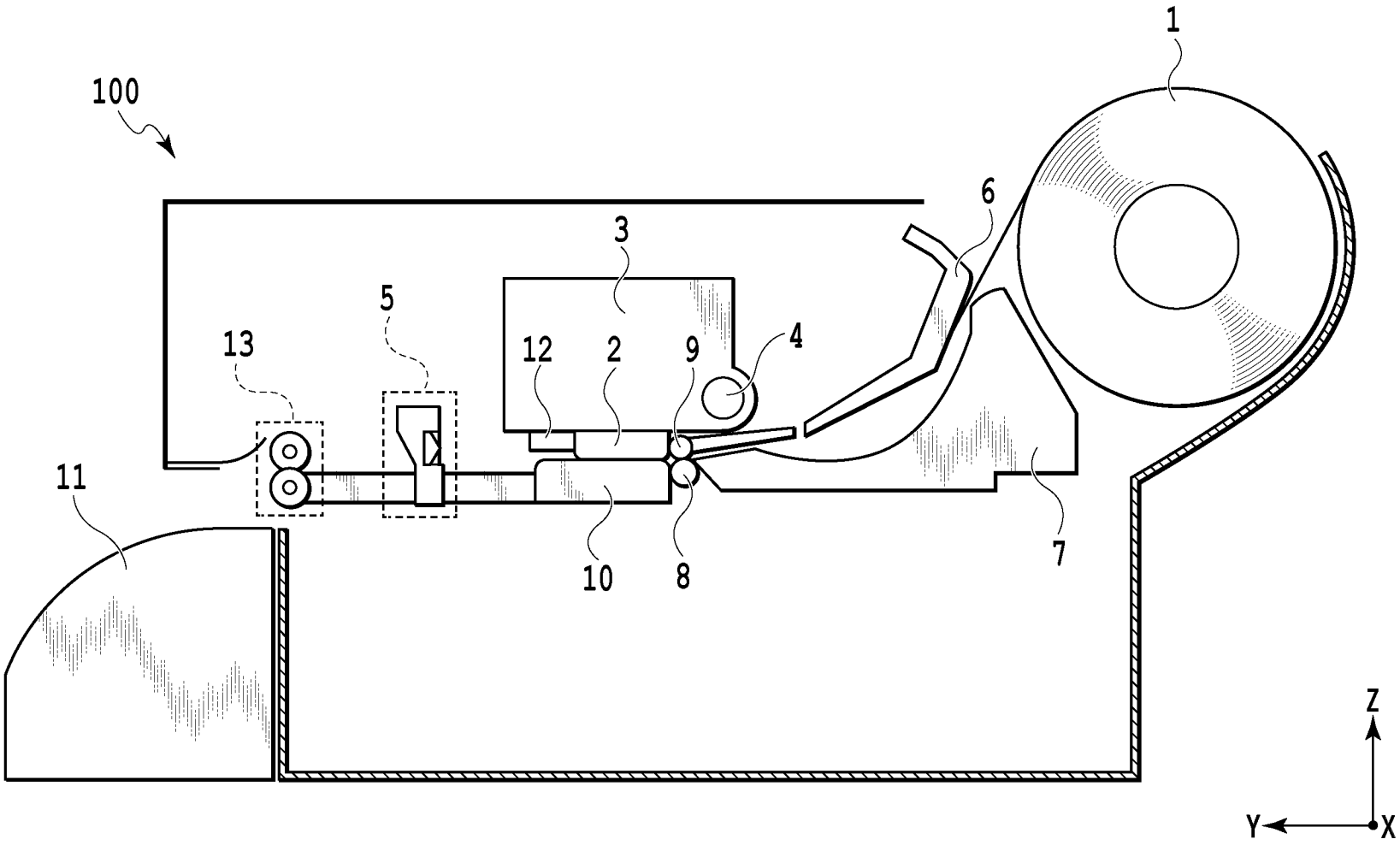
FIG. 1 is a cross-sectional view illustrating an example of a printing apparatus.

FIG. 1 is a cross-sectional view illustrating an example of an inkjet printing apparatus according to the present embodiment. The inkjet printing apparatus 100 (hereinafter simply referred to as the printing apparatus 100) performs printing on a printing medium that has a shape of a long sheet. In the present embodiment, the printing medium is a roll sheet 1. The roll sheet 1 held in the printing apparatus 100 is conveyed to the downstream through a conveyance path formed by the upper guide 6 and the lower guide 7. The roll sheet 1 is nipped by the conveyance roller 8 and the pinch roller 9 and conveyed to an image printing unit. The image printing unit is configured to include the print head 2, the carriage 3 on which the print head 2 is mounted, and the platen 10 disposed at a position facing the print head 2. The roll sheet 1 is conveyed onto the platen 10 by the conveyance roller 8. Ink is ejected by the print head 2 onto the roll sheet 1 conveyed to the image printing unit, so as to print an image.

The carriage 3 is supported so as to be able to perform a sliding motion along the guide shaft 4 and a guide rail (not illustrated in the drawing) that are disposed in parallel to each other in the printing apparatus 100. The carriage 3 includes the reflection type detection sensor 12 facing the platen 10, so as to be able to detect the reflectivity of a spot position. That is, in a case where the platen 10 is black and the roll sheet 1 is white, the reflectivity of the platen 10 and the roll sheet 1 are greatly different. Therefore, it is possible to determine whether the platen 10 is present or the roll sheet 1 is present at the spot position by use of the detection sensor 12. It is possible to detect the leading edge of the roll sheet 1 by utilizing the fact that, while the roll sheet 1 is conveyed by the conveyance roller 8, the reflectivity greatly changes in a case where the leading edge of the roll sheet 1 in the conveyance direction passes through the spot position of the detection sensor 12.

The carriage 3 scans in the X direction along the guide shaft 4 while holding the print head 2, and the print head 2 ejects ink while the carriage 3 scans, so as to perform printing on the roll sheet 1. After a scan by the carriage 3 to perform printing on the roll sheet 1, the conveyance roller 8 conveys the roll sheet 1 by a predetermined amount, and the carriage 3 scans on the roll sheet 1 again to perform printing. In this way, by repeating printing and conveying, the entire printing is completed. Furthermore, since the detection sensor 12 is mounted on the carriage 3, the positions of the paper edges in the width direction (X direction) of the roll sheet 1 can also be detected by the reciprocating operation of the carriage 3.

On the downstream relative to the carriage 3 in the conveyance direction of the roll sheet 1, there is provided the cutter 5 for cutting the roll sheet 1 in a direction intersecting the conveyance direction, and, on the further downstream, there is provided the slitter 13 for cutting the roll sheet 1 in the conveyance direction. On the downstream relative to the slitter 13, there is provided the discharging guide 11 for discharging the roll sheet 1 that has been cut.

The cutter 5 includes a cutter unit 300 (see FIG. 2) as a cutting mechanism for cutting the roll sheet 1 and a unit for moving the cutter unit 300 along the X direction. Furthermore, the slitter 13 includes a slitter unit 303 (see FIG. 2) as a cutting mechanism for cutting the roll sheet 1 and a unit for moving the slitter unit 303 along the X direction.

Figure 2:
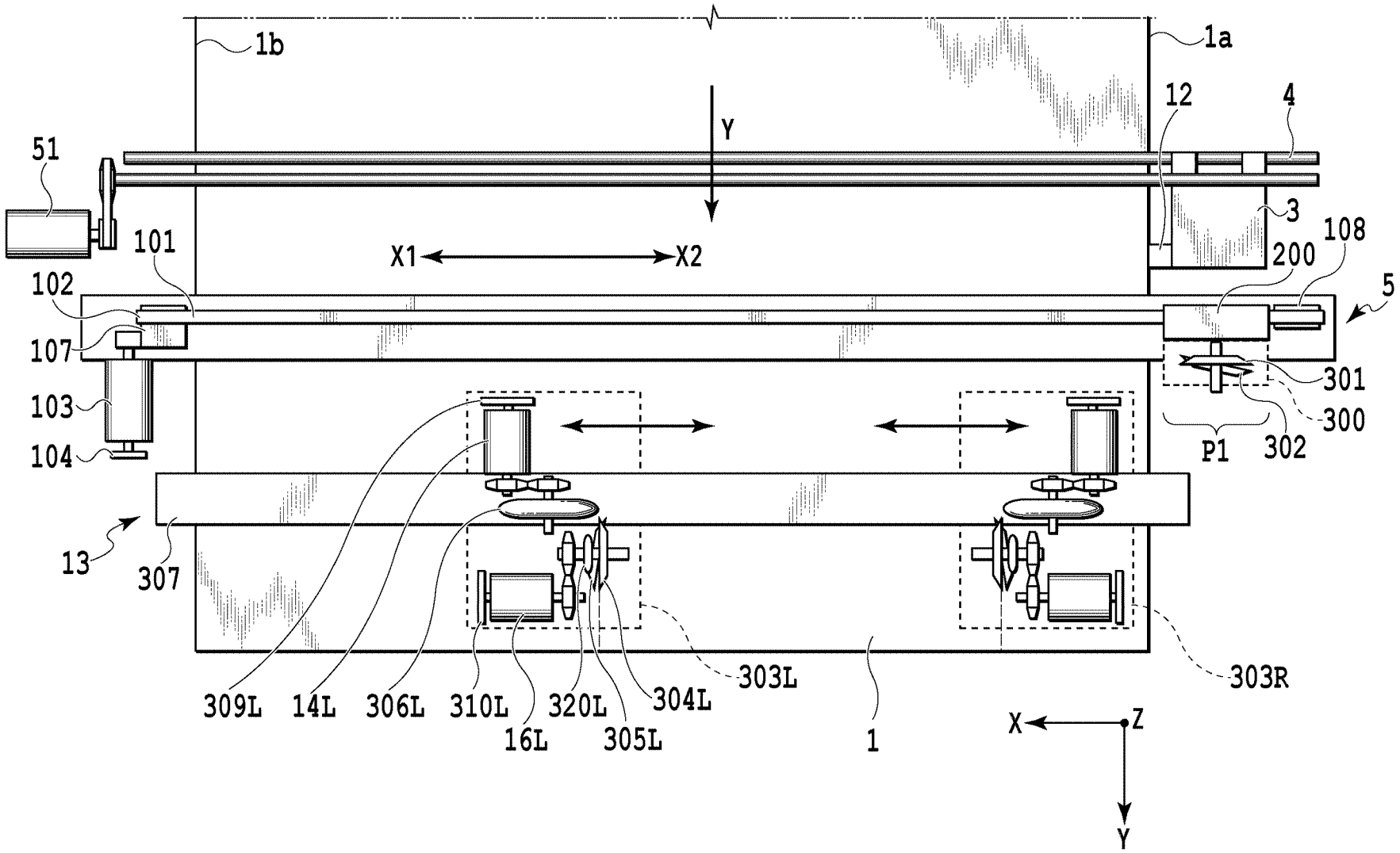
FIG. 2 is a top view of the printing apparatus.

FIG. 2 is a top view for explaining the cutter 5 and the slitter 13 including the slitter units 303L and 303R. In the present specification, "L" and "R" at the end of the reference signs indicate a member on the left side (that is, +X side) and a member on the right side (that is, −X side) on the drawings, respectively. In the present specification, such an end of a reference sign may be omitted in a case of members that are the same on the left side and the right side.

The guide rail 101 is configured to guide the cutter carriage 200 in the direction intersecting the conveyance direction of the roll sheet 1. The cutter carriage 200 integrally connects the cutter unit 300 and the belt 102. Furthermore, the belt 102 is configured to bridge the motor pulley 107 and the tensioner pulley 108 disposed on the left and right sides of the guide rail 101 and is configured to be moved by the cutter motor 103 connected to the motor pulley 107. The cutter motor 103 is provided with the cutter encoder 104. The cutter encoder 104 counts the number of pulses corresponding to driving of the cutter motor 103. Based on the origin position of the cutter carriage 200 and the number of pulses obtained by the cutter encoder 104, it is possible to control the movement position of the cutter unit 300 in the X1 and X2 directions.

The cutter unit 300 includes the upper movable blade 301 and the lower movable blade 302, so that the roll sheet 1 is cut at the contact point of the upper movable blade 301 and the lower movable blade 302 while the cutter unit 300 moves in the X1 direction. Furthermore, the upper movable blade 301 and the lower movable blade 302 are connected to the cutter motor 103 via the belt 102 and the cutter carriage 200 and are configured to be rotationally driven. In a case where the roll sheet 1 is cut, the roll sheet 1 is cut while the lower movable blade 302 and the upper movable blade 301, which is in contact with the lower movable blade 302, rotate together. In the example of FIG. 2, the cutter unit 300 performs cutting from the first end 1*a* of the roll sheet 1 to the second end 1*b* of the roll sheet 1. The first end 1*a* of the roll sheet 1 is an end on the stand-by position P1 side of the cutter unit 300. After the roll sheet 1 is cut, the cutter carriage 200 is reversed at a predetermined reversing position. Further, the cutter carriage 200 moves to a position that is the stand-by position P1 to stand by for the next cutting operation. Although the cutter unit 300 is mounted on the cutter carriage 200 in the example of the present embodiment, the cutter unit 300 may be mounted on the carriage 3 that moves the print head 2, etc., for example.

The slitter 13 is disposed on the downstream side relative to the cutter 5 in the conveyance direction of the roll sheet 1. The slitter 13 is able to move a slitter unit 303 to a given position in the X1 and X2 directions and is able to cut the roll sheet 1 in the direction parallel to the conveyance direction (+Y direction) by use of the slitter unit 303. In the present embodiment, an explanation is given of a configuration in which two slitter units 303 are mounted. That is, an explanation is given of the example in which the slitter units 303L and 303R are mounted. The slitter units 303L and 303R have the same configuration with the components that are left-right reversals in the X1 and X2 directions. In FIG. 2, for the sake of simplification, reference signs are mainly assigned to the components of the slitter unit 303L.

Figure 3A:
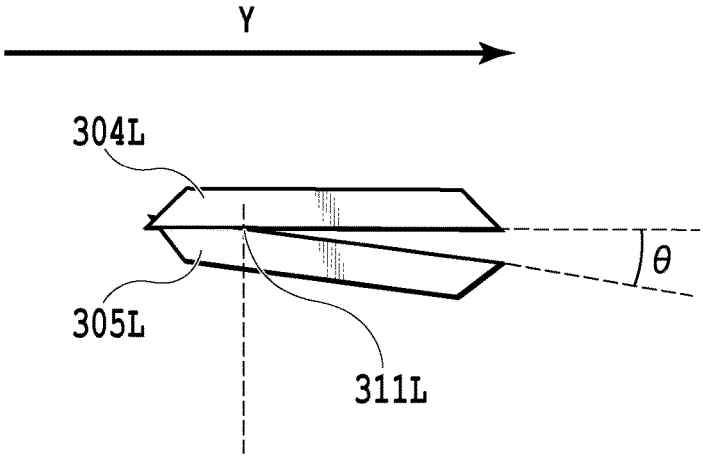
FIGS. 3A and 3B are diagrams for explaining movable blades of a slitter.
Figure 3B:
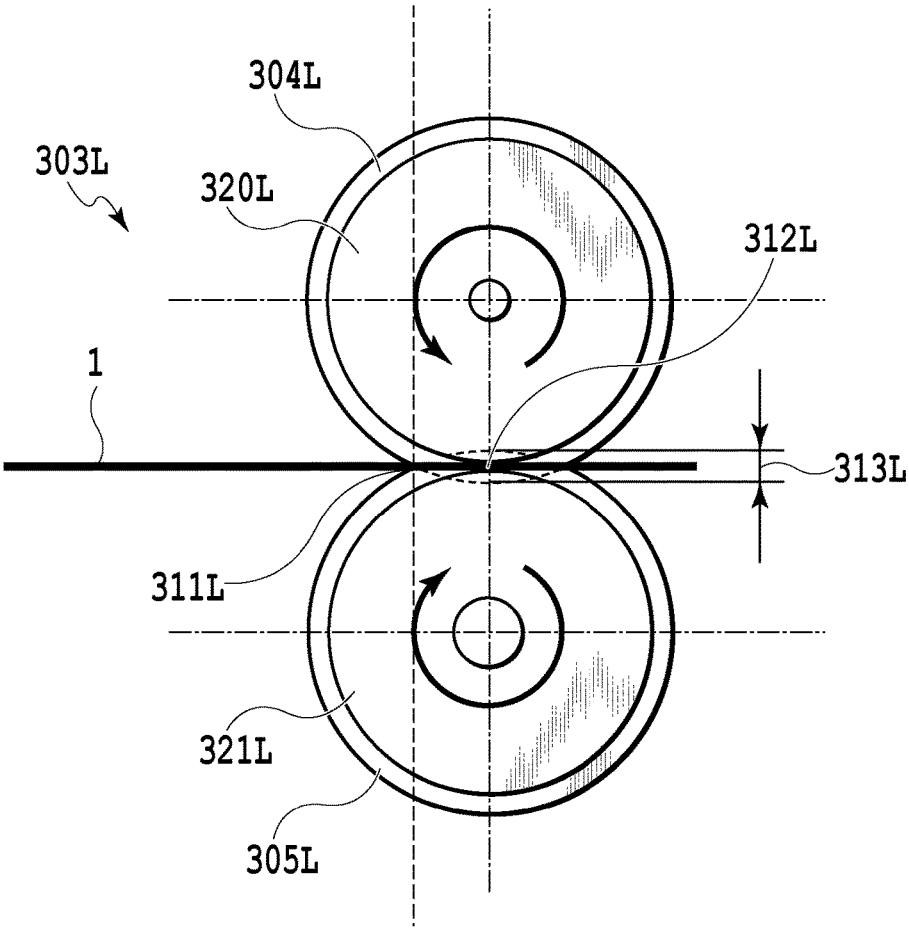
Figure 4:
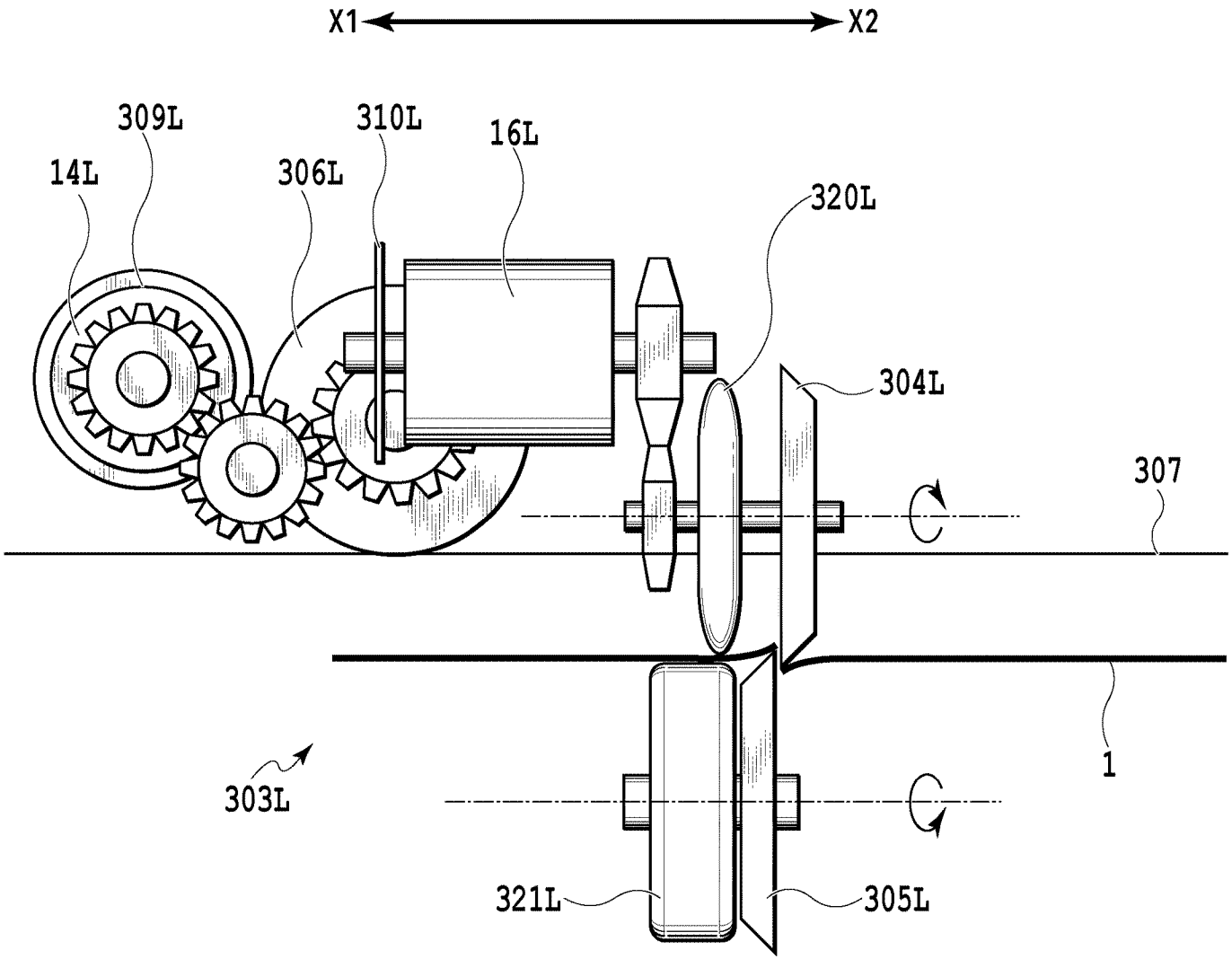
FIG. 4 is an enlarged view of a configuration in the vicinity of the slitter.

FIGS. 3A and 3B and FIG. 4 are diagrams for explaining details of the slitter unit 303L. FIG. 3A is a schematic top view of the slitter unit 303L, and FIG. 3B is a schematic side view of the slitter unit 303L. The slitter unit 303L includes the slitter upper movable blade 304L and the slitter lower movable blade 305L. The slitter upper movable blade 304L and the slitter lower movable blade 305L are disposed so as to have a round blades overlap amount 313L in the vertical direction and have a predetermined amount of angle (intersect angle) θ relative to the conveyance direction Y, which is the cutting direction. The roll sheet 1 is cut at the contact point 311L of the slitter upper movable blade 304L and the slitter lower movable blade 305L. The slitter upper movable blade 304L is connected to the slitter driving motor 16L via a gear.

In a case where the slitter upper movable blade 304L is rotated by the driving force of the slitter driving motor 16L, the slitter upper conveyance roller 320L, which is connected coaxially with the slitter upper movable blade 304L, rotates as well. The outer diameter of the slitter upper conveyance roller 320L is in contact with the outer diameter of the slitter lower conveyance roller 321L, which is connected coaxially with the slitter lower movable blade 305L, at the roller nip point 312L. Thus, by driving with friction transmission, while the roll sheet 1 is conveyed by the slitter upper conveyance roller 320L and the slitter lower conveyance roller 321L, the upper and lower blades rotate together to cut the roll sheet 1 in the conveyance direction. Since the slitter driving motor 16L is provided with the slitter driving encoder 310L, it is possible to control the slitter driving motor 16L with a predetermined rotation speed and a predetermined rotation amount. The slitter driving motor 16L is controlled to drive at a driving amount (specifically, a rotation speed and a rotation amount), which is synchronized with and corresponding to the conveyance amount by the conveyance roller 8.

The slitter unit 303L includes the slitter moving motor 14L and is configured such that driving force is transmitted to the slitter moving roller 306L via a gear. The slitter moving roller 306L abuts on the slitter guide rail 307, and the slitter unit 303L is configured to be movable in the X1 and X2 directions by friction between the front surface of the slitter moving roller 306L and the slitter guide rail 307. In other words, the slitter upper movable blade 304L, the slitter lower movable blade 305L, the slitter upper conveyance roller 320L, and the slitter lower conveyance roller 321L are integrally movable along the slitter guide rail 307.

Although the slitter moving roller 306L is driven with friction in the present embodiment, the slitter moving roller 306L may have a rack and pinion configuration with a slitter moving roller serving as a pinion and a slitter guide rail serving as a rack.

Next, an explanation is given of general operation of cutting by the slitter 13. First, the slitter units 303L and 303R are moved to cutting positions, and the roll sheet 1 is conveyed by the conveyance roller 8 while the conveyance motor 51 and the slitter driving motors 16L and 16R are driven at the same speed. In a case where the leading edge of the roll sheet 1 reaches the contact points 311L and 311R of the slitter 13, the roll sheet 1 is cut by the slitter upper movable blades 304L and 304R and the slitter lower movable blades 305L and 305R on the left and right sides. Furthermore, the roll sheet 1 is nipped and conveyed by the slitter upper conveyance rollers 320L and 320R and the slitter lower conveyance rollers 321L and 321R on the left and right sides while being cut, so as to be discharged through the discharging guide 11.

The configuration of the slitter 13 described above is merely an example. That is, the slitter 13 may have any configuration as long as the slitter 13 is movable in the width direction of the roll sheet 1 and is able to cut the conveyed roll sheet 1 in the conveyance direction at a given position of the width direction. Further, there may be a mode in which the slitter upper conveyance rollers 320 and the slitter lower conveyance rollers 321, the slitter upper movable blades 304, and the slitter lower movable blades 305 are independently driven.

Figure 5:
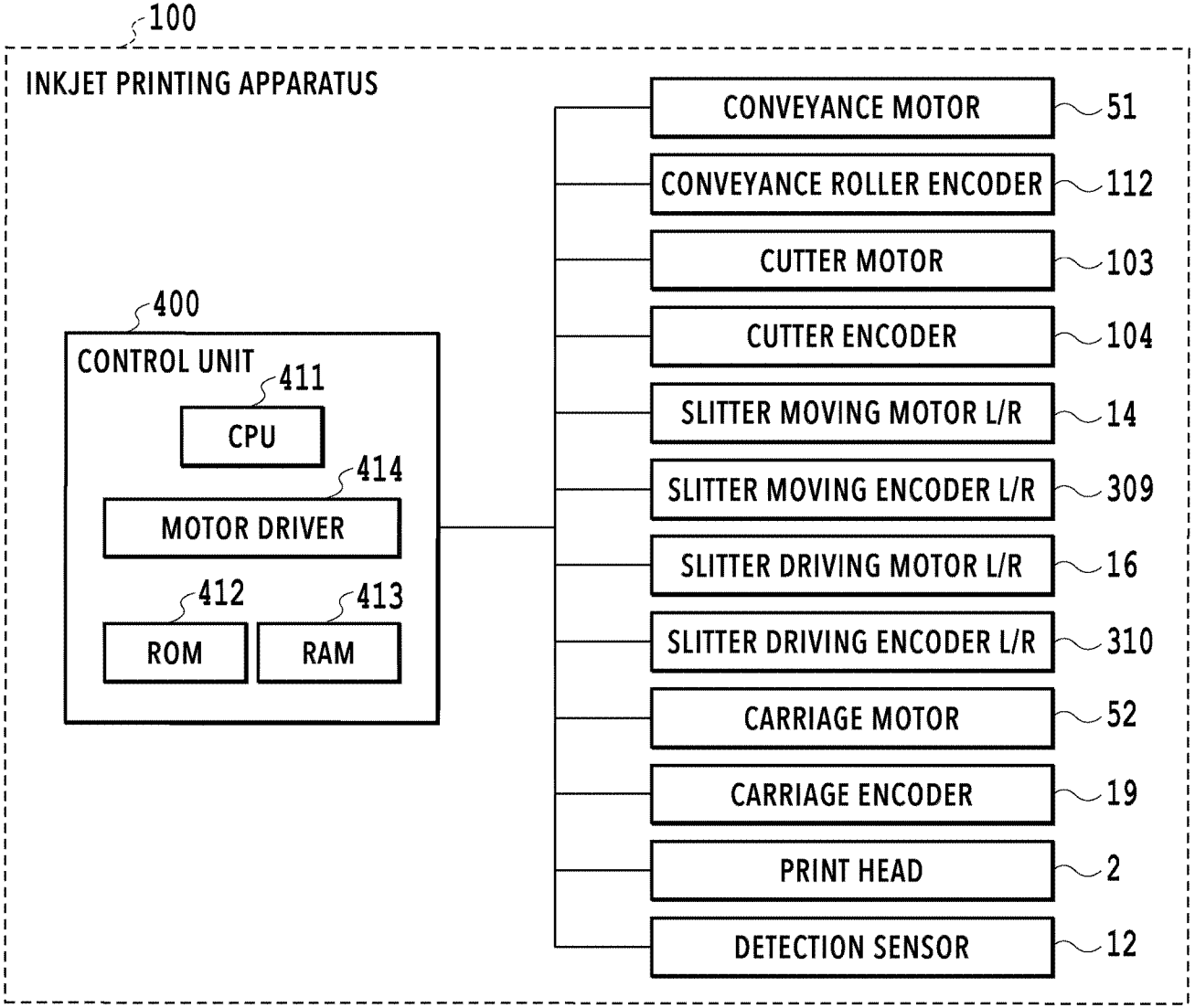
FIG. 5 is a schematic block diagram illustrating a control configuration of the printing apparatus.

FIG. 5 is a schematic block diagram illustrating a control configuration of the printing apparatus 100. The printing apparatus 100 includes a control unit 400. Furthermore, the control unit 400 includes a CPU 411, a ROM 412, a RAM 413, and a motor driver 414. The control unit 400 implements control of a conveyance motor 51, a cutter motor 103, a slitter moving motor 14, a slitter driving motor 16, a carriage motor 52, and a print head 2. The control unit 400 obtains signals from a conveyance roller encoder 112, a cutter encoder 104, a slitter moving encoder 309, a slitter driving encoder 310, a carriage encoder 19, and a detection sensor 12. Furthermore, the control unit 400 controls the various motors and the print head 2, based on the signals.

Cutting Operation and Image Printing Operation of a Comparative Example

In such a configuration as described above, cutting operation by the slitter 13 can be performed together with image printing operation. In the following, first, an explanation is given of the comparative example in which cutting operation by the slitter 13 is performed together with image printing operation, and then an explanation is given of the operation of the present embodiment.

In a case where cutting operation by the slitter 13 is performed together with image printing operation, the slitter units 303 move from stand-by positions to predetermined cutting positions in the X1 and X2 directions in accordance with a setting by a user. Then, the roll sheet 1 is conveyed by the conveyance roller 8 and the pinch roller 9 while the conveyance motor 51 and the slitter driving motors 16L and 16R are driven at the same speed. In the image printing unit, in response to forward or return scanning of one line by the carriage 3 for printing an image, the roll sheet 1 is conveyed by the conveyance roller 8 and the pinch roller 9 by a predetermined pitch. Then, the carriage 3 is moved again to perform image printing of the next line. In a case where printing proceeds and the leading edge of the roll sheet 1 reaches the contact points 311, the roll sheet 1 is cut by the slitter upper movable blades 304L and 304R and the slitter lower movable blades 305L and 305R that are rotating. Furthermore, the roll sheet 1 is nipped and conveyed by the slitter upper conveyance rollers 320L and 320R and the slitter lower conveyance rollers 321L and 321R while being cut. Then, the image printing ends and the cutting by the slitter unit 303 ends. Subsequently, the slitter units 303 move to the predetermined stand-by positions. The roll sheet 1 is conveyed to the position to be cut where the cutter 5 can cut the roll sheet 1, then the roll sheet 1 is cut by the cutter 5, so as to be discharged through the discharging guide 11.

As described above, in a case where cutting operation by the slitter 13 is performed together with image printing operation, the slitter units 303 cut the roll sheet 1 on which an image is printed. In this case, the roll sheet 1 absorbs ink and may float from the conveyance surface or bend so as to wave. For this reason, there is a possibility that the cutting line is shifted in a case where the roll sheet 1 is cut in parallel to the conveyance direction. On the other hand, according to the cutting operation and the image printing operation of the present embodiment explained below, it is possible to linearly cut the roll sheet 1 in parallel to the conveyance direction by use of the slitter units 303.

Cutting Operation and Image Printing Operation of the Present Embodiment

Figure 6:
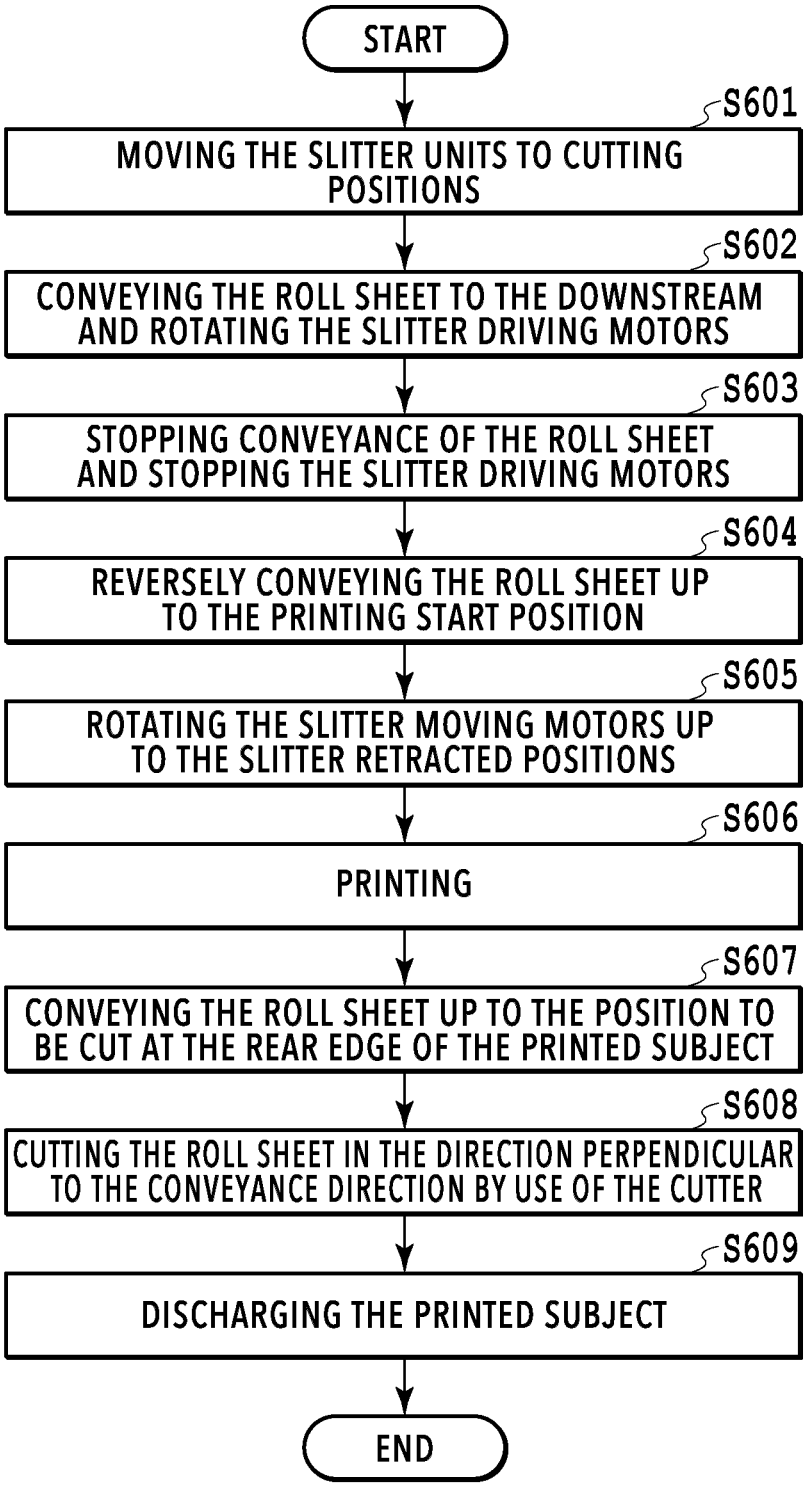
FIG. 6 is a flowchart illustrating a procedure of cutting operation and image printing operation.

FIG. 6 is a flowchart illustrating the procedure of the cutting operation and the image printing operation in the present embodiment. FIGS. 7 through 11 are conceptual diagrams of the operation according to the flowchart of FIG. 6. Hereinafter, an explanation is given with reference to FIGS. 6 through 11. The processing of FIG. 6 is performed by the CPU 411 of the printing apparatus 100 retrieving a program code stored in the ROM 412 into the RAM 413 and executing the program code. Alternatively, a part or all of the steps in FIG. 6 may be implemented by hardware such as an ASIC or an electronic circuit. The symbol "S" in the explanation of each process means that it is a step in the sequence. The processing illustrated in FIG. 6 is started in response to a print job, which is received by the printing apparatus 100.

In S601, the control unit 400 moves the slitter units 303R and 303L to cutting positions in the intersecting direction, which intersects the conveyance direction, in accordance with the sheet width size of the printed subject based on the print job. That is, the control unit 400 drives the slitter moving motors 14 until the slitter units 303R and 303L move along the slitter guide rail 307 to the cutting positions in the intersecting direction.

In S602, the control unit 400 drives the slitter driving motors 16 while driving the conveyance motor 51 to convey the roll sheet 1 to the downstream side in the conveyance direction. In this state, in a case where the leading edge of the roll sheet 1 in the conveyance direction is conveyed to the positions of the slitter units 303R and 303L, cutting by the slitter units 303R and 303L is started from the leading edge of the roll sheet 1.

Figure 7:
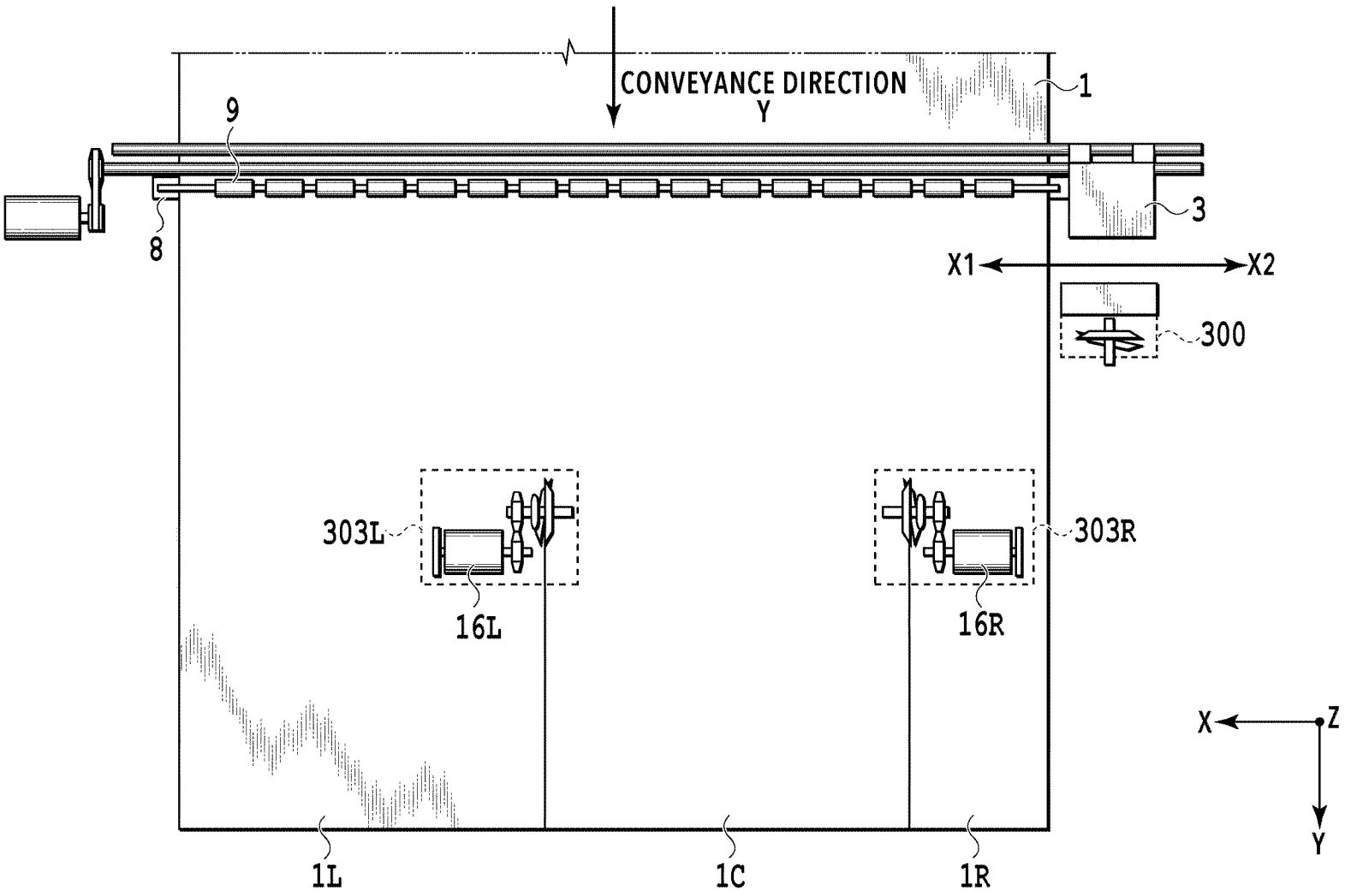
FIG. 7 is a conceptual diagram of operation of the printing apparatus.

FIG. 7 is a diagram illustrating a situation in which the roll sheet 1 is being cut by the slitter units 303R and 303L in the direction parallel to the conveyance direction. In the present embodiment, the roll sheet 1 is cut in the direction parallel to the conveyance direction by the slitter units 303R and 303L first, instead of immediately starting the printing operation in response to the reception of the print job.

In step S603, the control unit 400 makes the conveyance roller 8 and the pinch roller 9 convey the roll sheet 1 until the cutting by the slitter units 303R and 303L reaches a predetermined position in the conveyance direction of the roll sheet 1. Although the roll sheet 1 is conveyed also by the slitter upper conveyance rollers 320 and the slitter lower conveyance rollers 321 as described above, a description of the conveyance by the slitter upper conveyance rollers 320 and the slitter lower conveyance rollers 321 is omitted for the sake of simplicity of explanation.

Here, the predetermined position in the conveyance direction of the roll sheet 1 is determined based on print data included in the print job. Specifically, the predetermined position is the rear edge position of the image based on the print data. The rear edge of the image may include the margin area. In other words, the predetermined position in the conveyance direction of the roll sheet 1 is the rear edge position to be cut, which corresponds to the rear edge of the printed subject. The control unit 400 drives the conveyance motor 51 and the slitter driving motors 16 in accordance with the size of the printed subject based on the print job. In a case where the predetermined position is reached, the control unit 400 stops the conveyance motor 51 and the slitter driving motors 16. That is, the cutting of the roll sheet 1 in the direction parallel to the conveyance direction is ended. In this way, since the roll sheet 1 is cut before ink is ejected by the print head 2 onto the roll sheet 1, it is possible to prevent the cutting line from shifting in a case where the roll sheet 1 is cut in the direction parallel to the conveyance direction.

Subsequently, in S604, the control unit 400 reversely drives the conveyance motor 51 to rotate the conveyance roller 8 in the opposite direction, so as to convey the roll sheet 1 in the opposite direction (−Y direction) of the conveyance direction (hereinafter referred to as reverse conveyance). Since the print head 2 is positioned on the upstream relative to the slitter units 303R and 303L in the conveyance direction, operation of rewinding the roll sheet 1 is performed in order to start printing. The rotation amount in the opposite direction corresponds to the print data based on the print job. Specifically, the conveyance roller 8 is rotated in the opposite direction until the printing start position of the roll sheet 1 where the printing of the image is started by the print head 2 based on the print data reaches the position where scan-printing by the print head 2 is performed.

Figure 8:
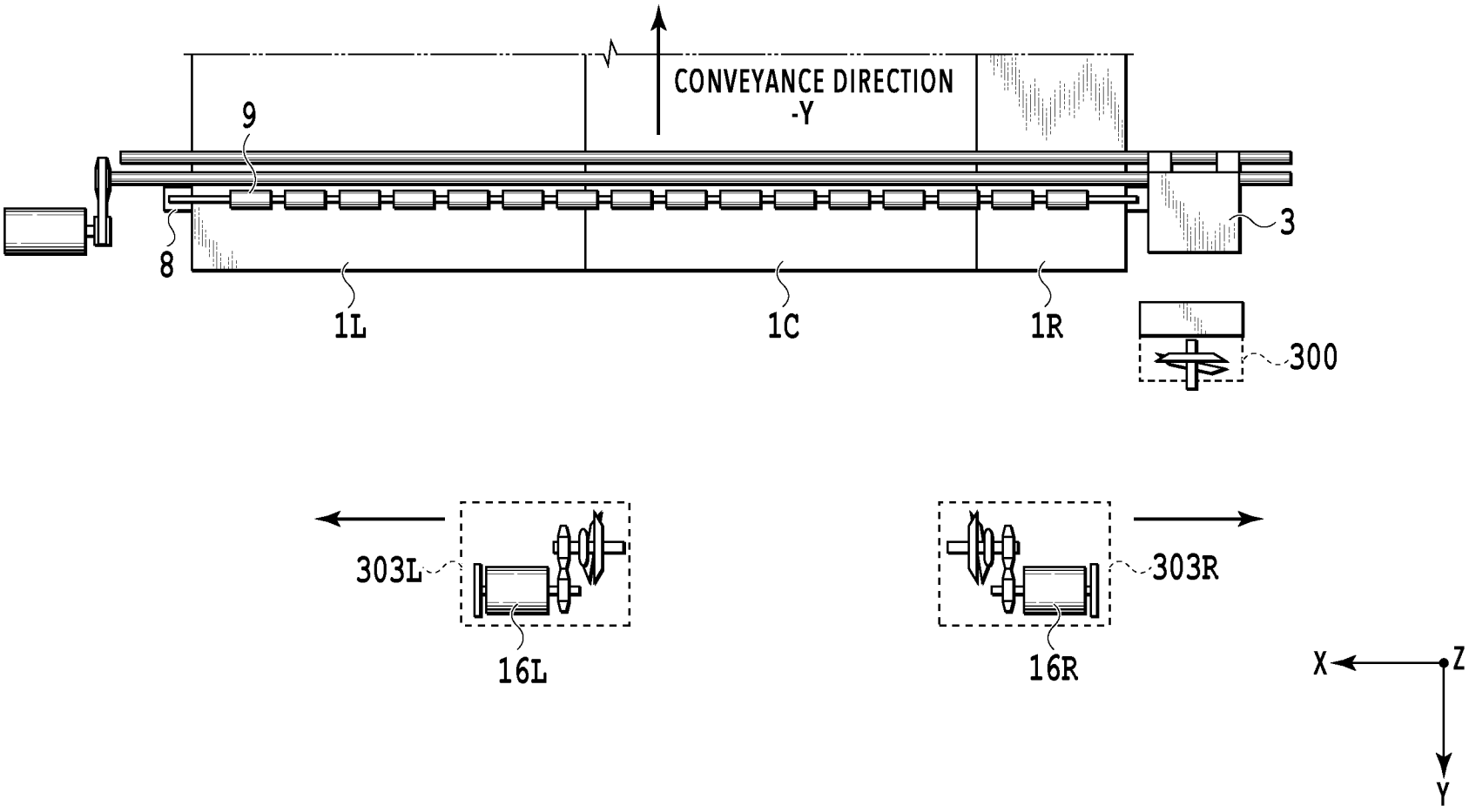
FIG. 8 is a conceptual diagram of operation of the printing apparatus.

FIG. 8 is a diagram illustrating a situation in which the roll sheet 1 is reversely conveyed by the conveyance roller 8 and the pinch roller 9 until the printing start position of the roll sheet 1 reaches the position where scan-printing by the print head 2 is performed. In a case where the printing start position of the reversely conveyed roll sheet 1 reaches the position where scan-printing by the print head 2 is performed, the control unit 400 stops driving of the conveyance motor 51 to stop the reverse conveyance by the conveyance roller 8. Here, the roll sheet 1 is in a state where cutting lines (slits) are made by the slitter units 303R and 303L.

In S605, the control unit 400 drives the slitter moving motors 14L and 14R to retract the slitter units 303R and 303L to the outside of the sheet width. The slitter units 303R and 303L only need to be retracted from the conveyance path of the roll sheet 1 and may be retracted upward in the gravitational direction (Z direction).

In S606, the control unit 400 starts the printing operation. That is, after the roll sheet 1 is conveyed by the conveyance roller 8 and the pinch roller 9 by a predetermined amount, printing by the print head 2 is performed. An image is printed by repeating conveyance and printing operation in this way. Accordingly, the image corresponding to the print data based on the print job is printed on the roll sheet 1.

Figure 9:
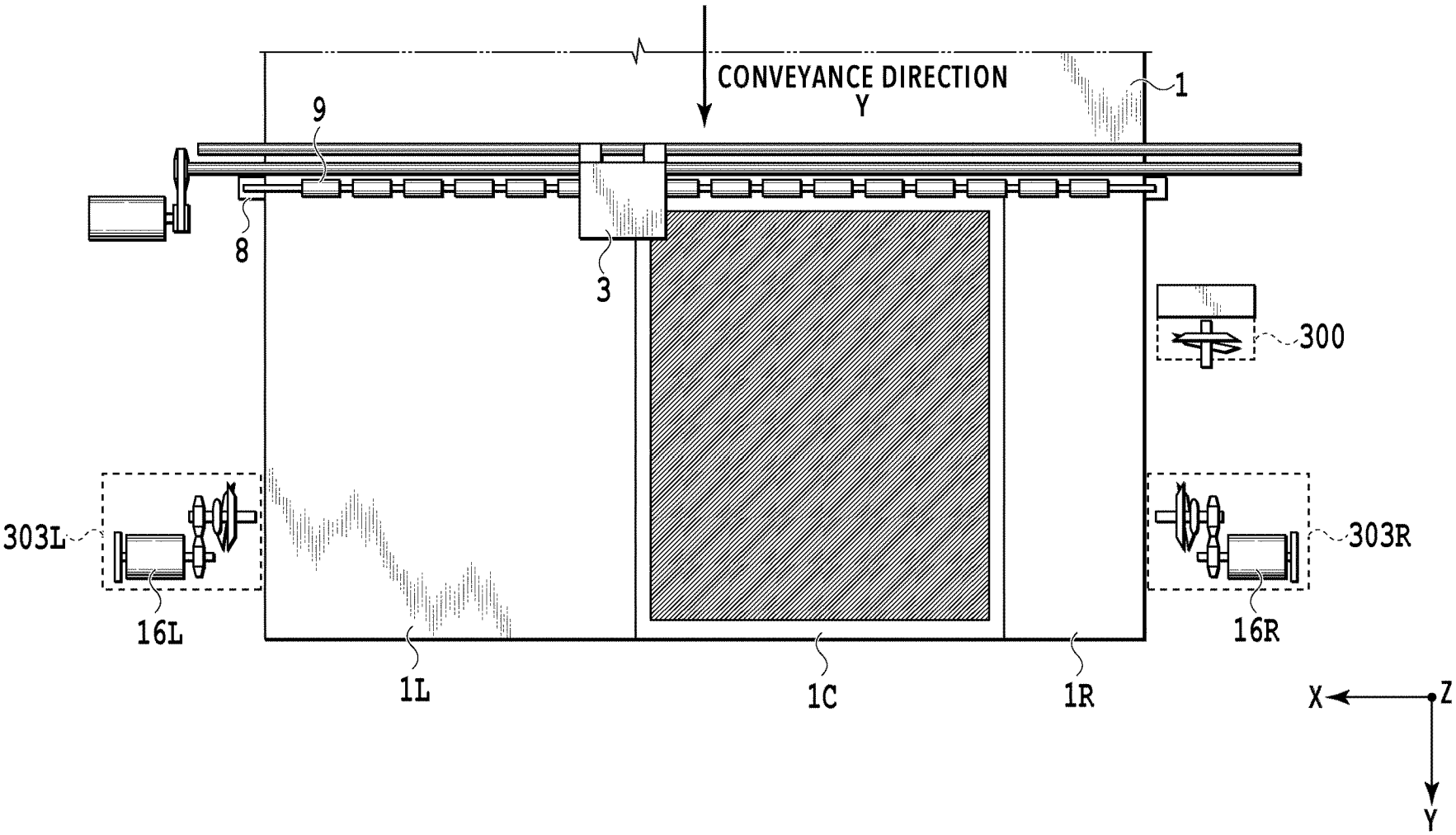
FIG. 9 is a conceptual diagram of operation of the printing apparatus.

FIG. 9 is a diagram in which the slitter units 303R and 303L are retracted to the retracted positions and printing by the print head 2 is completed.

In S607, the control unit 400 conveys the roll sheet 1 until the rear edge position of the roll sheet 1 to be cut reaches the scanning position (cutting position) of the cutter unit 300 in the conveyance direction, in order to cut the rear edge of the printed subject by use of the cutter unit 300. Then, in S608, the control unit 400 drives the cutter motor 103 to cut the roll sheet 1 in the direction intersecting the conveyance direction (direction perpendicular to the conveyance direction) by use of the cutter unit 300.

Figure 10:
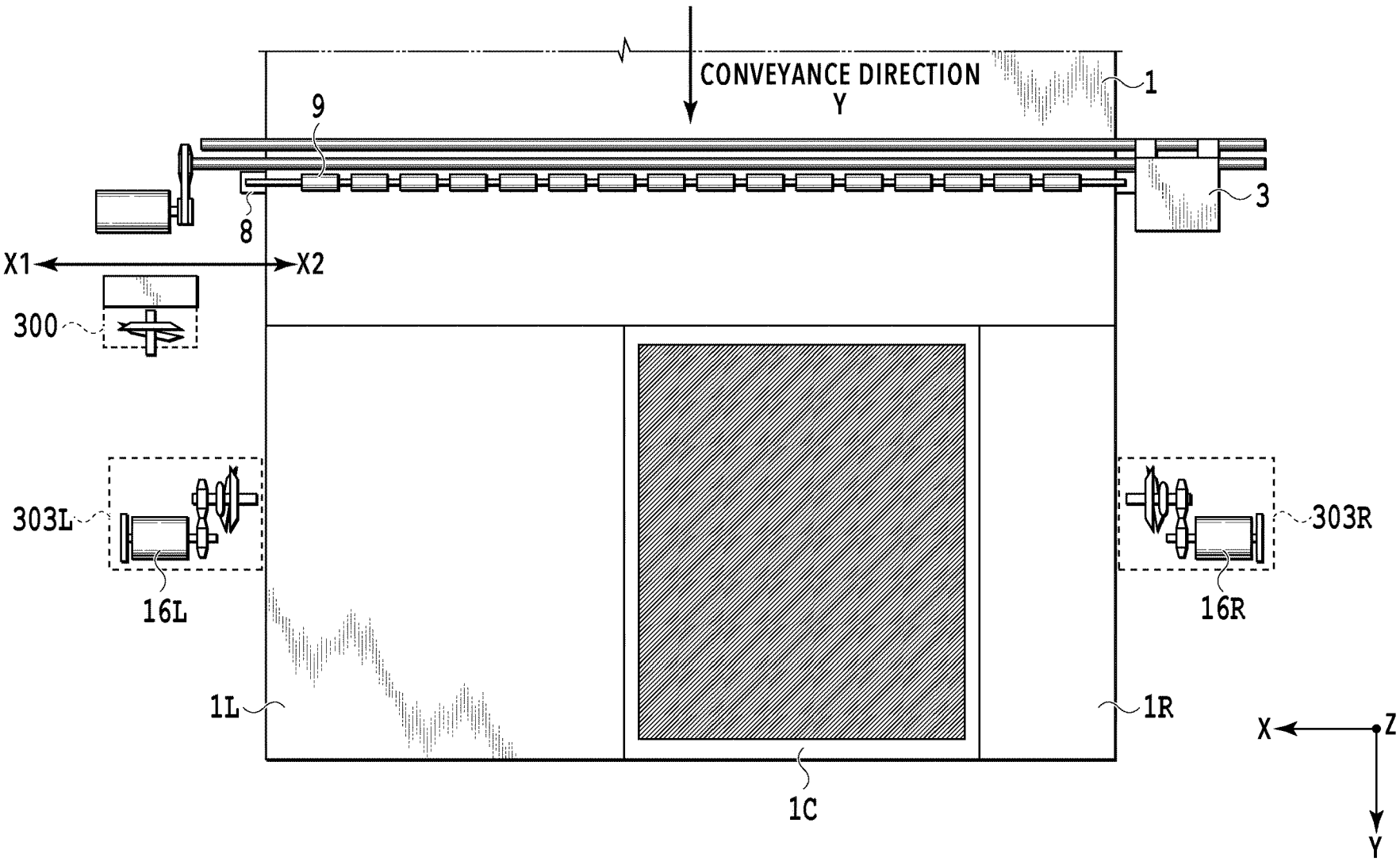
FIG. 10 is a conceptual diagram of operation of the printing apparatus.
Figure 11:
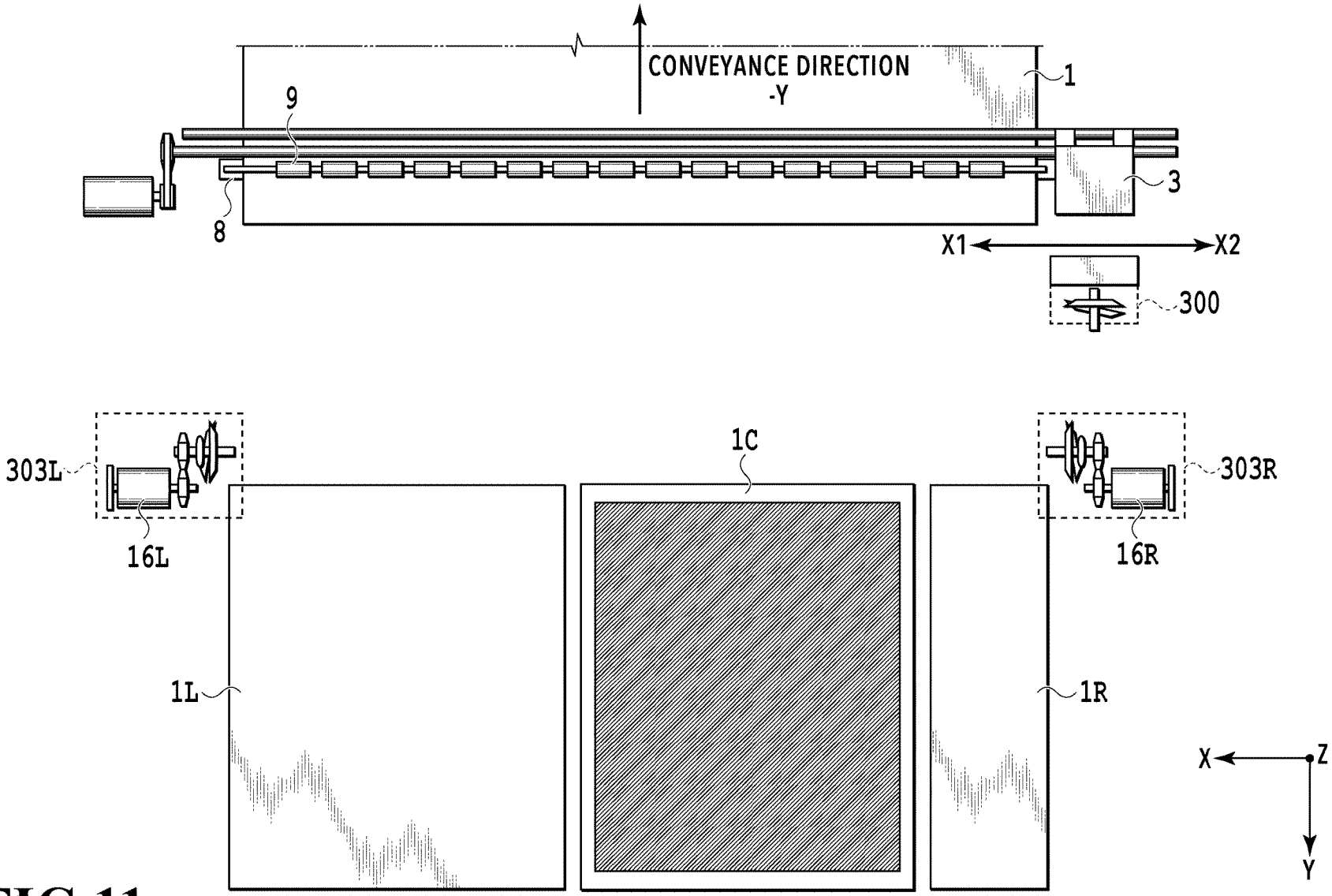
FIG. 11 is a conceptual diagram of operation of the printing apparatus.

FIG. 10 is a diagram illustrating a situation in which the roll sheet 1, which is conveyed until the rear edge position to be cut reaches the scanning position of the cutter unit 300, is cut by the cutter unit 300. The cut printed subject 1C and the cut pieces 1R and 1L are discharged by their own weight in S609. The control unit 400 reversely conveys the roll sheet 1 to prepare for the next printing. FIG. 11 is a diagram illustrating a situation in which the printed subject 1C and the cut pieces 1R and 1L are discharged and the roll sheet 1 is rewound.

Here, the explanation has been given with the example in which the rear edge position of the roll sheet 1 to be cut by the slitter units 303R and 303L in the conveyance direction is conveyed to be positioned on the scanning line of the cutter unit 300. Furthermore, the example in which the cutting by the cutter unit 300 is performed once has been explained. Here, the cutting by the cutter unit 300 may be performed twice. For example, the cutting by the slitter units 303R and 303L in S603 may be performed at a position beyond the rear edge position to be cut, which corresponds to the rear edge of the printed subject 1C, by a predetermined length. Then, after the printing of the image, the roll sheet 1, which is conveyed so that the rear edge position to be cut that corresponds to the rear edge of the printed subject 1C is positioned on the scanning line of the cutter unit 300, may be cut by the cutter unit 300 in S608. Further, subsequently, the roll sheet 1 may be further conveyed by an amount corresponding to the predetermined length and cut by the cutter unit 300 again. According to such operation, it is possible to reliably crop the printed subject 1C by cutting by use of the cutter unit 300 in S608.

As explained above, in the present embodiment, in a case where processing based on a print job is performed, the roll sheet 1 is cut by the slitter units 303 in the direction parallel to the conveyance direction up to the rear edge position of the printed subject before the printing operation by the print head 2. That is, since cutting by a slitter unit 303 is performed before ink is ejected onto a roll sheet 1, it is possible to perform the cutting by the slitter unit 303 without an effect by the ink. For example, it is possible to perform cutting without being in the state where a roll sheet 1 absorbs ink and floats from the conveyance surface or bends so as to wave. Therefore, in a case where a roll sheet 1 is cut in parallel to the conveyance direction by a slitter unit 303, it is possible to prevent the cutting line from shifting and improve the accuracy of cutting.

Modification Example

In the first embodiment, the explanation has been given of the case in which there is a margin around the printed subject 1C. That is, what is termed as bordered printing operation has been explained. However, printing without a margin, or what is termed as borderless printing, may be implemented by the same operation as well. In a case of borderless printing, printing is performed so as to protrude outward in the width direction from the printed subject 1C during the printing operation as illustrated in FIG. 9. That is, printing is performed across the printed subject 1C and the cut pieces 1R and 1L. The other aspects of the operation are the same as in a case of bordered printing.

Second Embodiment

In the first embodiment, the explanation has been given with the example of a mode in which one printed subject is created in the width direction of a roll sheet. In the present embodiment, an explanation is given of a mode in which multiple printed subjects are created in the width direction of a roll sheet.

The procedure of the cutting operation and the image printing operation in the present embodiment is the same as illustrated in the flowchart of FIG. 6. FIGS. 12 through 16 are conceptual diagrams of operation in the present embodiment.

In S601, the control unit 400 moves the slitter units 303R and 303L to cutting positions in accordance with the sheet width size of printed subjects based on the print job. The slitter units 303R and 303L move along the slitter guide rail 307 to the cutting positions. Next, in S602, the control unit 400 drives the slitter driving motors 16 while conveying the roll sheet 1 to the downstream side in the conveyance direction.

Figure 12:
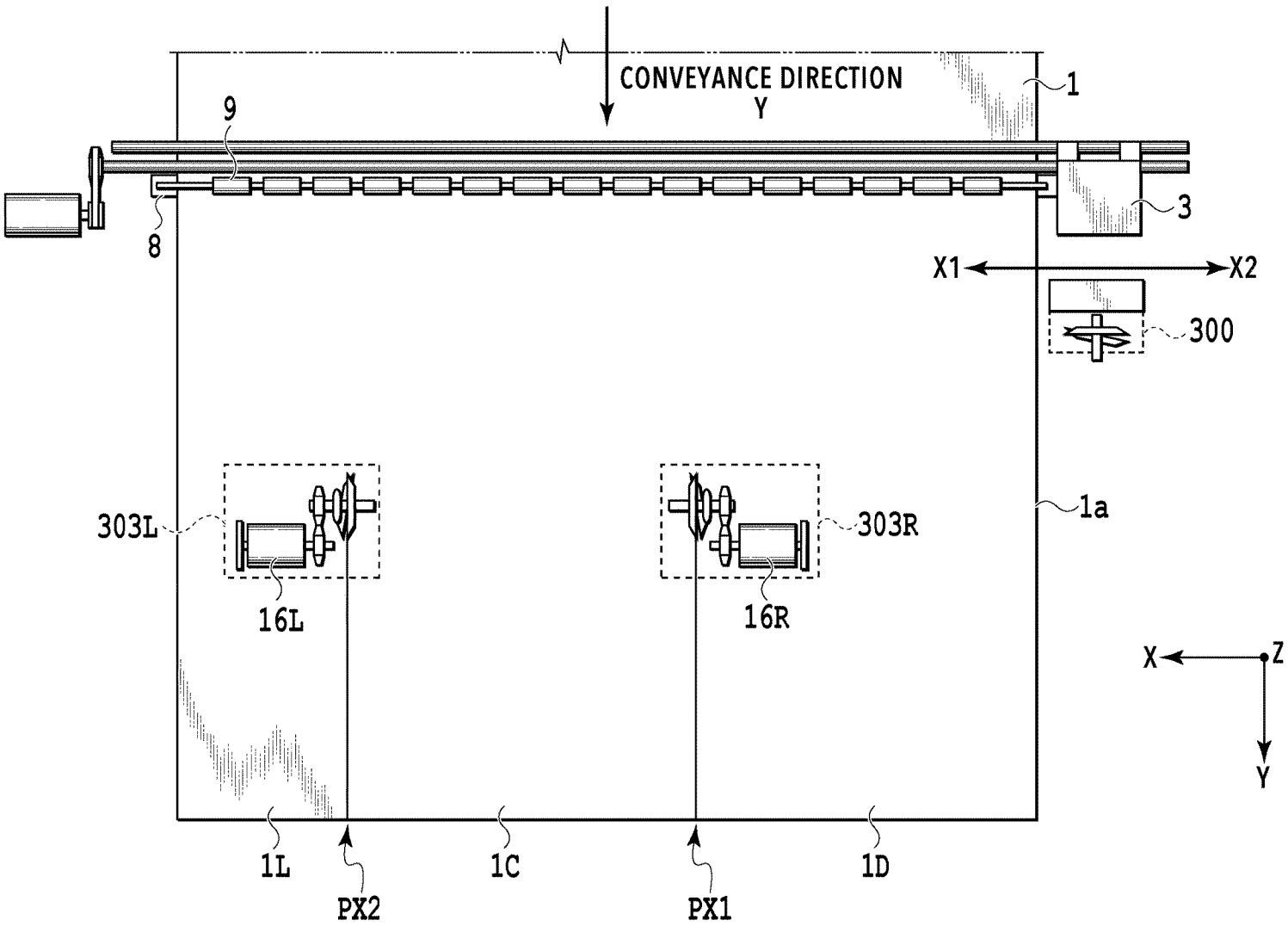
FIG. 12 is a conceptual diagram of operation of the printing apparatus.

FIG. 12 is a diagram illustrating a situation in which the roll sheet 1 is being cut by the slitter units 303R and 303L in the direction parallel to the conveyance direction. In the present embodiment, with the first end 1*a* of the roll sheet 1 regarded as the reference, the slitter unit 303R is moved to the cutting position PX1 that is away from the first end 1*a* in accordance with the width corresponding to the first printed subject 1D. The slitter unit 303L is moved to the cutting position PX2 that is away from the cutting position PX1 in accordance with the width corresponding to the second printed subject 1C. Then, cutting by the slitter units 303R and 303L is performed.

In S603, the control unit 400 stops cutting in the direction parallel to the conveyance direction in accordance with the sizes of the printed subjects based on the print job in the conveyance direction. That is, the control unit 400 stops driving of the slitter driving motors 16 and the conveyance motor 51. Although it is assumed that printed subjects in the same size are created as the first printed subject 1D and the second printed subject 1C in the present embodiment, it is possible that printed subjects in different sizes are created. In that case, for example, cutting by the slitter units 303R and 303L may be performed in accordance with the printed subject in the larger size in the conveyance direction of the roll sheet 1.

Then, in S604, the control unit 400 reversely drives the conveyance motor 51 to rotate the conveyance roller 8 in the opposite direction (−Y direction). The rotation amount in the opposite direction corresponds to the print data based on the print job. Here, an explanation is given on the assumption that images of the same size are printed as the first printed subject 1D and the second printed subject 1C. However, in a case of different sizes, the rotation amount may be determined in accordance with the print data of the larger image size.

Figure 13:
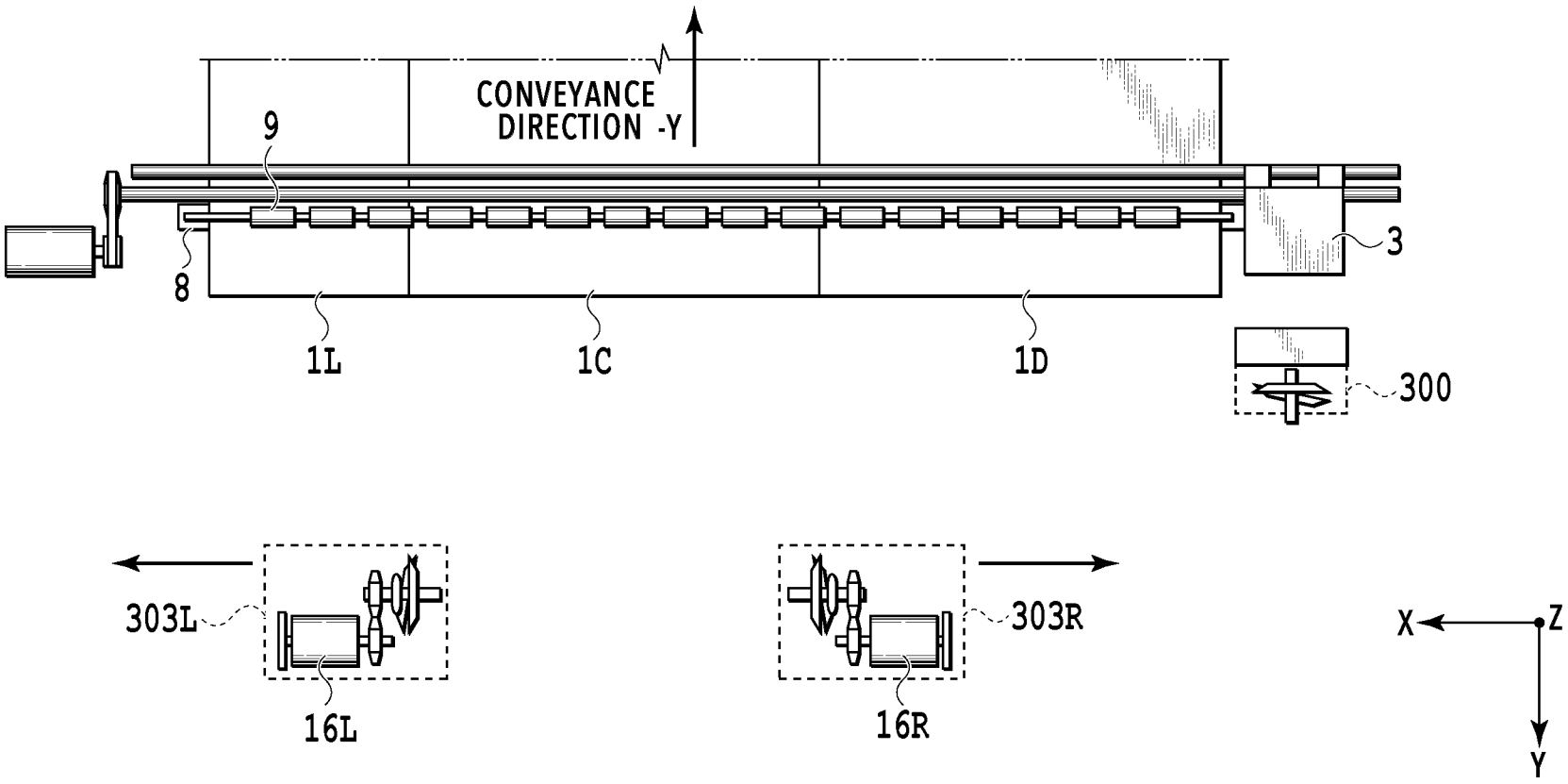
FIG. 13 is a conceptual diagram of operation of the printing apparatus.

FIG. 13 is a diagram illustrating a situation in which the roll sheet 1 is reversely conveyed by the conveyance roller 8 until the printing start position of the roll sheet 1 reaches the position where scan-printing by the print head 2 is performed. In a case where the printing start position of the roll sheet 1 reaches the position where scan-printing by the print head 2 is performed, the control unit 400 stops driving of the conveyance roller 8.

After retracting the slitter units 303R and 303L in S605, the control unit 400 starts the printing operation in S606. That is, after the roll sheet 1 is conveyed by the conveyance roller 8 and the pinch roller 9 by a predetermined amount, printing by the print head 2 is performed. An image is printed by repeating conveyance and printing operation in this way. The print head 2 prints an image on each of the print areas for the first printed subject 1D and the second printed subject 1C.

Figure 14:
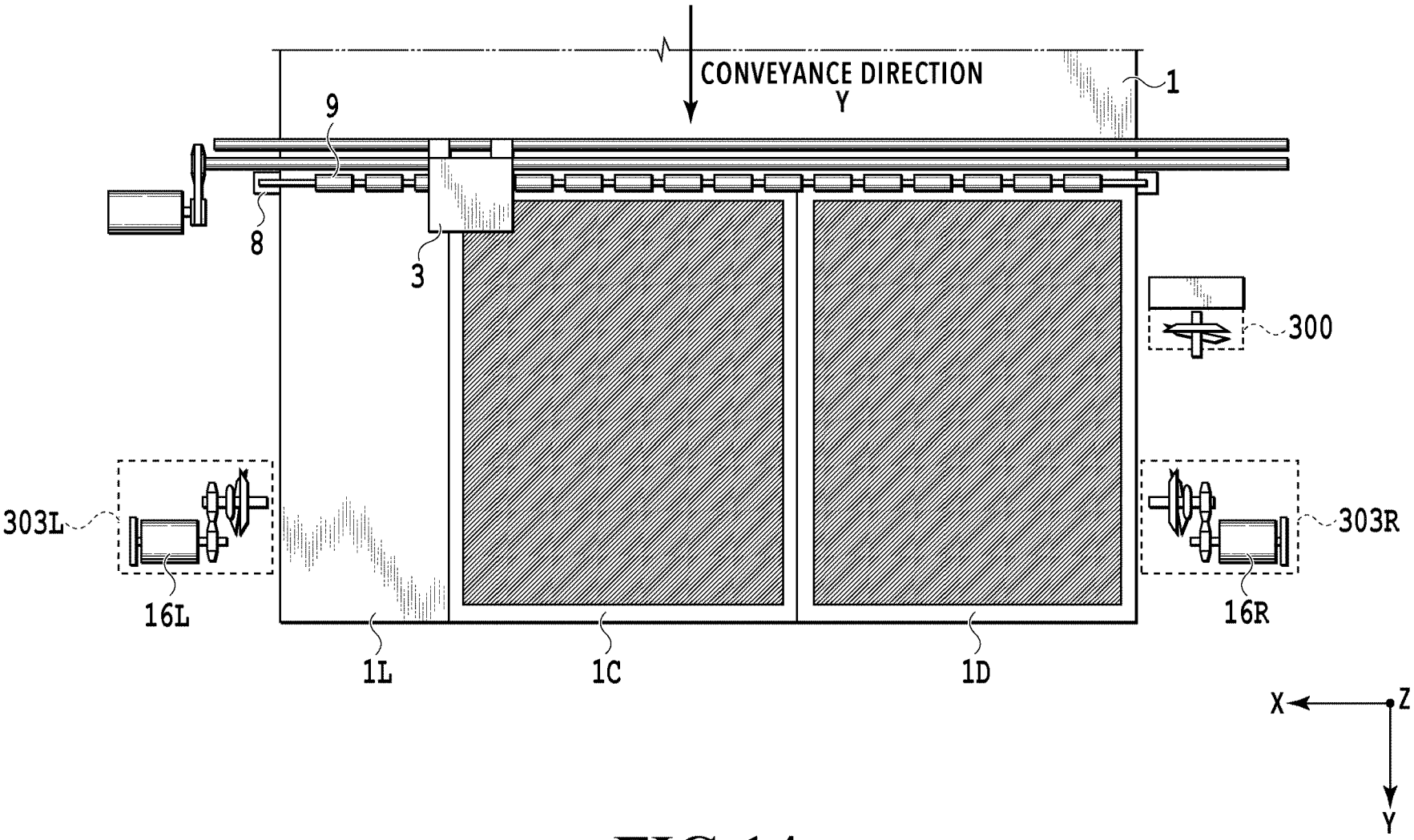
FIG. 14 is a conceptual diagram of operation of the printing apparatus.

FIG. 14 is a diagram in which the slitter units 303R and 303L are retracted to the retracted positions and printing by the print head 2 is completed.

In S607, the control unit 400 conveys the roll sheet 1 until the rear edge position of the roll sheet 1 to be cut reaches the scanning position (cutting position) of the cutter unit 300 in the conveyance direction, in order to cut the rear edge of the printed subject by use of the cutter unit 300. Then, in S608, the control unit 400 drives the cutter motor 103 to cut the roll sheet 1 in the direction intersecting the conveyance direction (direction perpendicular to the conveyance direction) by use of the cutter unit 300.

Figure 15:
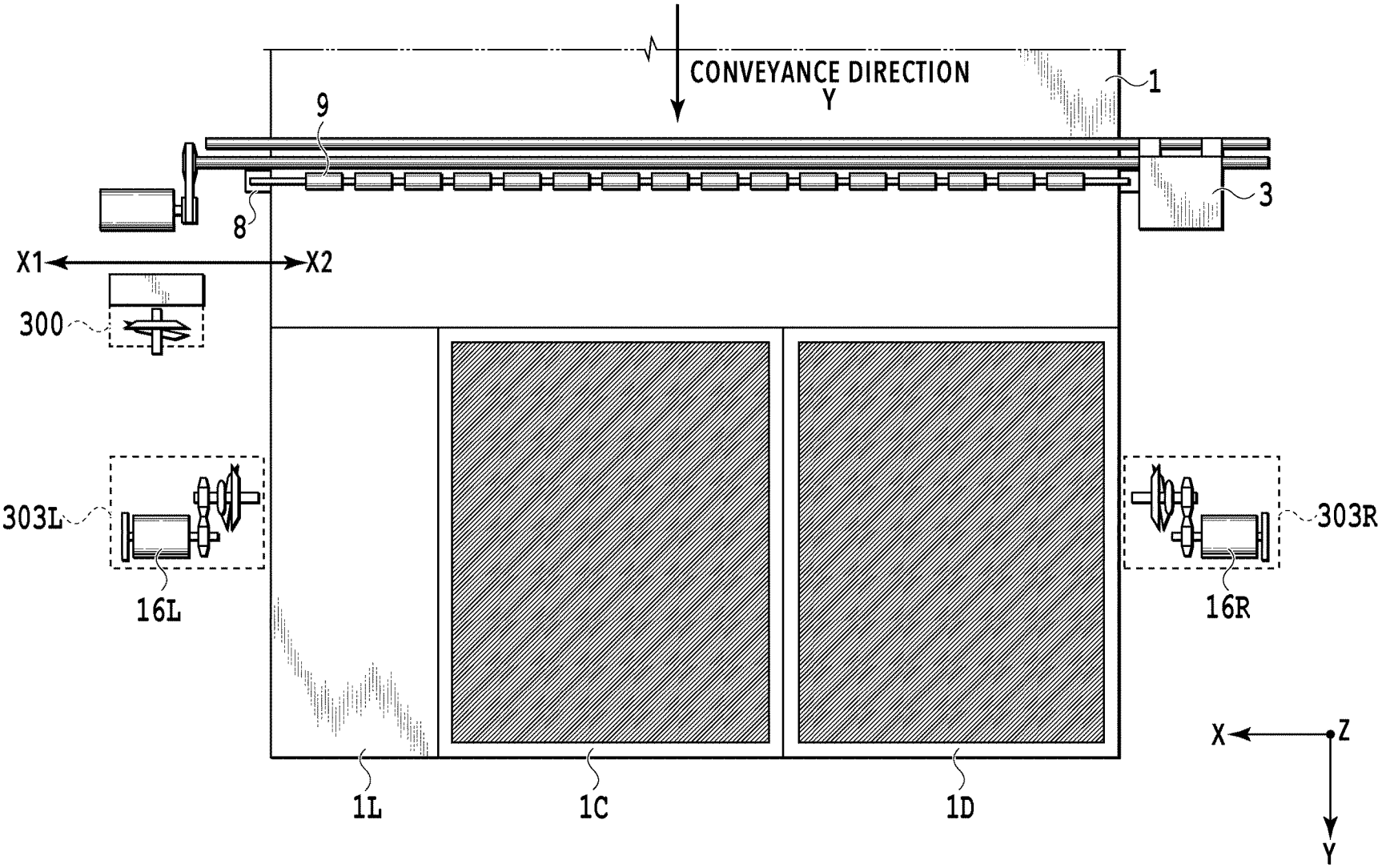
FIG. 15 is a conceptual diagram of operation of the printing apparatus.
Figure 16:
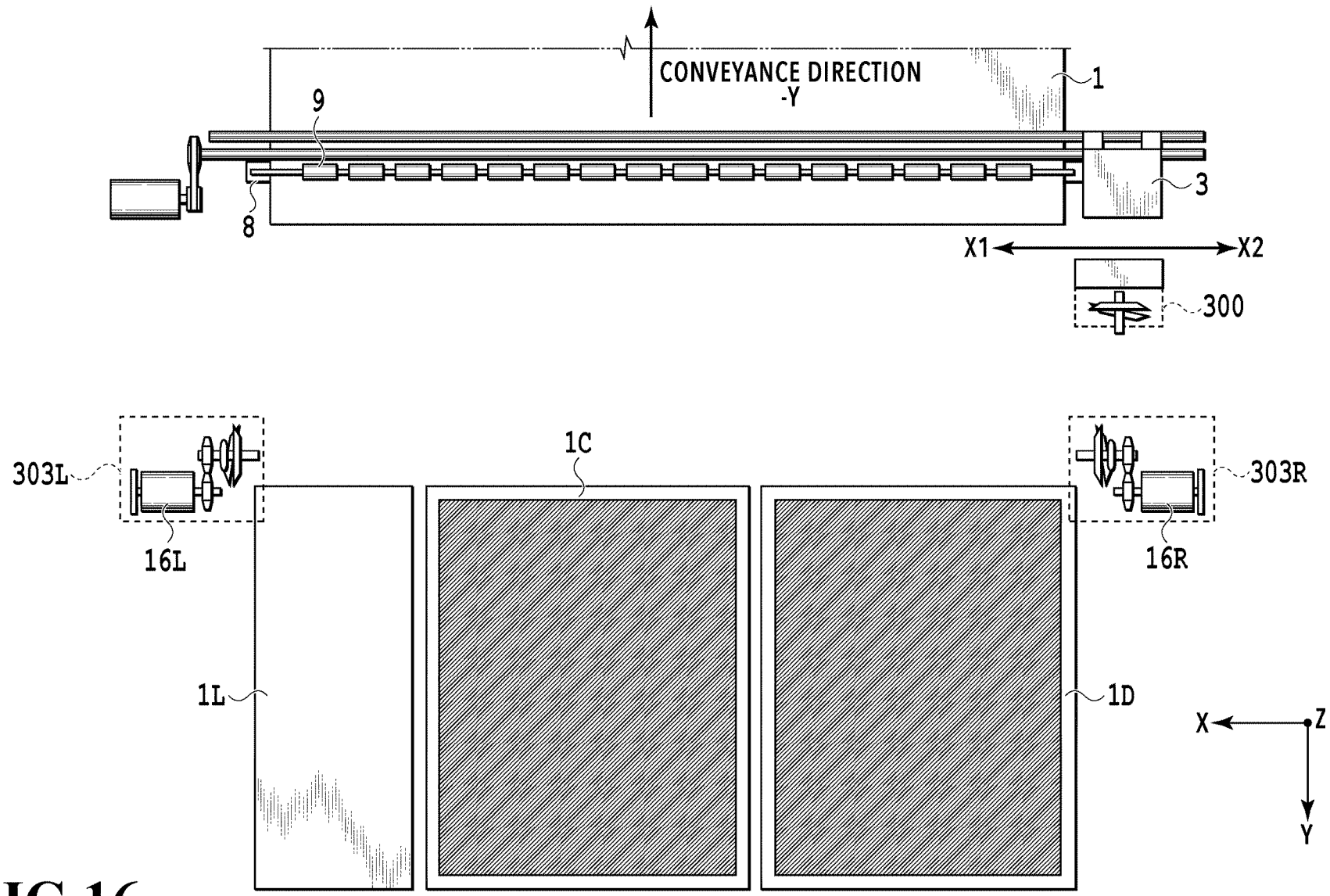
FIG. 16 is a conceptual diagram of operation of the printing apparatus.

FIG. 15 is a diagram illustrating a situation in which the roll sheet 1, which is conveyed until the rear edge position to be cut reaches the scanning position of the cutter unit 300, is cut by the cutter unit 300. The first printed subject 1D, the second printed subject 1C, and the cut piece 1L, which are cut out by cutting by use of the cutter unit 300, are discharged by their own weight in S609. Further, the control unit 400 reversely conveys the roll sheet 1 to prepare for the next printing. FIG. 16 is a diagram illustrating a situation in which the first printed subject 1D, the second printed subject 1C, and the cut piece 1L are discharged and the roll sheet 1 is rewound.

As described above, even in a mode in which multiple printed subjects are created in the width direction of a roll sheet 1, the roll sheet 1 is cut up to the rear edge position of a printed subject by use of a slitter unit 303 before printing by the print head 2 is performed on the roll sheet 1. That is, since cutting by a slitter unit 303 is performed before printing with ink is performed on a roll sheet 1, it is possible to perform the cutting by the slitter unit 303 without an effect by the ink. Therefore, in a case where the roll sheet 1 is cut in parallel to the conveyance direction by the slitter unit 303, it is possible to prevent the cutting line from shifting.

OTHER EMBODIMENTS

In the above-described embodiments, the explanations have been given with the example of a printing apparatus in which the carriage 3 scans in the X direction while holding the print head 2, so as to perform printing operation. However, there may be a mode in which a print head that is provided with ejection openings corresponding to the size of the printing medium in the width direction, which may be termed as a line-type print head, is used.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-066220, filed Mar. 29, 2019, which is hereby incorporated by reference wherein in its entirety.

What is claimed is:

1. An inkjet printing apparatus comprising:

a conveyance unit configured to convey a printing medium in a conveyance direction;

a print head configured to print an image on the printing medium conveyed by the conveyance unit; and a slitter disposed on a downstream relative to the print head in the conveyance direction and configured to cut the printing medium in the conveyance direction in accordance with the conveyance by the conveyance unit, wherein the slitter is configured to cut the printing medium from a leading edge of the printing medium up to a predetermined position in accordance with the conveyance of the printing medium by the conveyance unit, and wherein the print head is configured to print the image in between the leading edge of the printing medium and the predetermined position in the conveyance direction after the printing medium is cut by the slitter.

2. The inkjet printing apparatus according to claim 1, wherein the predetermined position is determined based on print data indicating the image to be printed.

3. The inkjet printing apparatus according to claim 2, wherein the predetermined position corresponds to a position of a rear edge of the image to be printed.

4. The inkjet printing apparatus according to claim 3, wherein the rear edge of the image to be printed includes a margin.

5. The inkjet printing apparatus according to claim 1, wherein the conveyance unit is configured to convey the printing medium in the conveyance direction up to a position so that the printing medium is cut by the slitter up to the predetermined position, and then convey the printing medium in an opposite direction of the conveyance direction until a printing start position, at which printing of the image on the printing medium that has been cut up to the predetermined position is started, reaches a position at which the print head performs printing.

6. The inkjet printing apparatus according to claim 5, wherein the print head is configured to start printing the image after the conveyance in the opposite direction is completed.

7. The inkjet printing apparatus according to claim 1 further comprising a cutter disposed on a downstream relative to the print head as well as an upstream relative to the slitter in the conveyance direction and configured to cut the printing medium in an intersecting direction, which intersects the conveyance direction, wherein the cutter is configured to cut the printing medium that has been cut up to the predetermined position in the conveyance direction.

8. The inkjet printing apparatus according to claim 7, wherein the conveyance unit is configured to convey the printing medium in the conveyance direction until the predetermined position of the printing medium on which the printing by the print head has been completed reaches a cutting position of the cutter.

9. The inkjet printing apparatus according to claim 7, wherein the slitter is configured to cut the printing medium up to a second position that is beyond the predetermined position in the conveyance direction, and wherein the cutter is configured to cut the printing medium in the intersecting direction at the predetermined position of the conveyance direction, the printing medium having been cut up to the second position.

10. The inkjet printing apparatus according to claim 1, wherein the print head is configured to perform printing in an intersecting direction, which intersects the conveyance direction, across a position that has been cut by the slitter.

11. The inkjet printing apparatus according to claim 1, wherein the slitter includes a first slitter unit and a second slitter unit, wherein the first slitter unit is configured to cut the printing medium at a first position that is away from an end of an intersecting direction, which intersects the conveyance direction of the printing medium, the first position corresponding to a size of a first printed subject in the intersecting direction, and wherein the second slitter unit is configured to cut the printing medium at a second position that is away from the first position, the second position corresponding to a size of a second printed subject in the intersecting direction.

12. The inkjet printing apparatus according to claim 11, wherein, in the intersecting direction, the print head is configured not to perform printing at positions that have been cut by the first slitter unit and the second slitter unit and is configured to perform printing on each of an area corresponding to the first printed subject and an area corresponding to the second printed subject.

13. A control method of an inkjet printing apparatus including a conveyance unit, a print head, and a slitter, the conveyance unit being configured to convey a printing medium in a conveyance direction, the print head being configured to print an image on the printing medium conveyed by the conveyance unit, the slitter being disposed on a downstream relative to the print head in the conveyance direction and configured to cut the printing medium in the conveyance direction in accordance with the conveyance by the conveyance unit, the control method comprising:

cutting the printing medium from a leading edge of the printing medium up to a predetermined position by conveying the printing medium, the cutting being performed by the slitter, the conveying being performed by the conveyance unit; and printing the image in between the leading edge of the printing medium and the predetermined position in the conveyance direction after the cutting, the printing being performed by the print head.

14. A non-transitory computer readable storage medium storing a program which causes a computer to perform a control method of an inkjet printing apparatus including a conveyance unit, a print head, and a slitter, the conveyance unit being configured to convey a printing medium in a conveyance direction, the print head being configured to print an image on the printing medium conveyed by the conveyance unit, the slitter being disposed on a downstream relative to the print head in the conveyance direction and configured to cut the printing medium in the conveyance direction in accordance with the conveyance by the conveyance unit, the control method comprising:

cutting the printing medium from a leading edge of the printing medium up to a predetermined position by conveying the printing medium, the cutting being performed by the slitter, the conveying being performed by the conveyance unit; and printing the image in between the leading edge of the printing medium and the predetermined position in the conveyance direction after the cutting, the printing being performed by the print head.

* * * * *